US012539890B2

(12) United States Patent
McFarlane

(10) Patent No.: US 12,539,890 B2
(45) Date of Patent: Feb. 3, 2026

(54) RAIL-AND-TROLLEY SYSTEMS

(71) Applicant: Bomac Engineering Pty. Ltd., Hallam (AU)

(72) Inventor: Tate McFarlane, Hallam (AU)

(73) Assignee: Bomac Engineering Pty. Ltd., Hallam (AU)

( * ) Notice: Subject to any disclaimer, the term of this patent is extended or adjusted under 35 U.S.C. 154(b) by 856 days.

(21) Appl. No.: 17/773,833

(22) PCT Filed: Oct. 29, 2020

(86) PCT No.: PCT/AU2020/051171
§ 371 (c)(1),
(2) Date: May 2, 2022

(87) PCT Pub. No.: WO2021/081587
PCT Pub. Date: May 6, 2021

(65) Prior Publication Data

US 2022/0363293 A1 Nov. 17, 2022

(30) Foreign Application Priority Data

Oct. 31, 2019 (AU) ..... 2019904120

(51) Int. Cl.
*B61B 3/02* (2006.01)
*B61B 3/00* (2006.01)

(52) U.S. Cl.
CPC . *B61B 3/00* (2013.01); *B61B 3/02* (2013.01)

(58) Field of Classification Search
CPC .... B61B 3/00; B61B 3/02; B61B 5/00; B61B 5/02; B61B 13/04
See application file for complete search history.

(56) References Cited

U.S. PATENT DOCUMENTS 4,248,157 A 2/1981 Evans
5,357,868 A 10/1994 Mass
(Continued)

FOREIGN PATENT DOCUMENTS

AU 684599 B2 12/1997
AU 2011265552 A1 7/2013
(Continued)

OTHER PUBLICATIONS

PCT/AU2020/051171 , "International Search Report and Written Opinion", Nov. 16, 2020, 16 pages.

*Primary Examiner* — Robert J McCarry, Jr.
(74) *Attorney, Agent, or Firm* — Kilpatrick Townsend & Stockton LLP

(57) ABSTRACT

Disclosed is a system or kit for forming an assembly comprising a rail trolley engageable with a rail to be moveable therealong, the system or kit comprising: at least one portion which a body of the trolley is to comprise ("body portion"), the body portion(s) being configured to define at least one slot in said body; and one or more wheels connectable or connected to at least one said body portion, or connectable to said body, the system or kit including at least one component connectable to the body through at least one said slot in the body and/or in one or more said body portions, or connected to at least one said body portion through at least one said slot therein, such that the position of a resulting interconnection between the/each component and the body in the assembly is variable along the slot(s) through which that component is connected.

8 Claims, 12 Drawing Sheets

(56) References Cited

U.S. PATENT DOCUMENTS

| | | | | |
|---|---|---|---|---|
| 10,399,779 | B2 | 9/2019 | Fenile et al. | |
| 2010/0005998 | A1* | 1/2010 | Kempf | B66C 9/02 104/106 |
| 2015/0321887 | A1 | 11/2015 | Kwon et al. | |
| 2016/0046444 | A1 | 2/2016 | Fenile et al. | |

FOREIGN PATENT DOCUMENTS

| | | | |
|---|---|---|---|
| CN | 205953355 | U | 2/2017 |
| CN | 208103739 | U | 11/2018 |
| GB | 2317866 | A | 4/1998 |
| KR | 101346433 | B1 | 1/2014 |

* cited by examiner

RAIL-AND-TROLLEY SYSTEMS

RELATED APPLICATIONS

This application is a U.S. National Phase of International Application No. PCT/AU2020/051171, filed Oct. 29, 2020, claiming priority to Australian Patent Application No. 2019904120, filed Oct. 31, 2019, contents of which are hereby incorporated by reference in their entirety.

FIELD OF THE INVENTION

The present invention relates to rail-and-trolley systems of the type comprising a trolley and a rail along which the trolley is movable, typically to carry a load supported from the trolley. Given the rail defines a track along which the trolley moves, such systems are also referred to as "trolley track systems". Trolley track systems are nowadays relatively popular given their suitability to numerous applications, including in jib arms, cranes (including monorail and gantry cranes), hoists, overhead suspension viewing systems, and palliative care apparatuses and high-volume storage apparatuses.

BACKGROUND

In many such applications, optimum characteristics of the trolley may vary according to changing factors such as the role which the trolley is to perform, the configuration and/or weight of a given load the trolley is to carry, the manner in which such a load is to be connected to the trolley and the configuration of the rail to be engaged by the trolley.

There is an ongoing need for flexibility in the manufacture and configurability of trolley track systems, and especially trolleys of such systems.

SUMMARY OF THE INVENTION

According to a first aspect of the invention, there is provided a method of manufacturing a rail trolley having a body and one or more wheels mounted to the body to be receivable against a rail such that the trolley engages the rail to be moveable therealong, the method comprising providing in an appropriate length, which corresponds to a desired length of the body, at least one length of section to define a portion of which the body is comprised ("body portion"), and mounting the wheel(s) to at least one said body portion.

In preferred embodiments of the invention, the method includes producing the or each length of section. Producing each length may comprise cutting it from section. Alternatively or additionally, producing each length may comprise forming, particularly mechanically forming, the section. Forming of the section preferably comprises extruding the section though may, alternatively or additionally, comprise other kinds of mechanical forming, such as, for example, pultrusion and hot and/or cold rolling.

Preferably, plural said lengths of section are provided, each in a said appropriate length thereof, and the method comprises interconnecting said lengths of section in laterally opposed relation, whereby said body comprises plural, laterally opposed, said body portions, to be to either side of the rail, and respective said wheels are mounted to ones of the body portions such that they are on opposite sides of the body to engage opposite lateral sides of the rail.

According to a second aspect of the present invention, there is provided the rail trolley manufactured by said method.

According to a third aspect of the present invention, there is provided a system or kit for forming an assembly which comprises a rail trolley that has a body and one or more wheels mounted to the body to receivable against a rail such that the trolley engages the rail to be moveable therealong, the system or kit comprising:

at least one portion which said body comprises or is to comprise ("body portion"), the, each, or at least one said, body portion being configured to define at least one slot in said body; and said wheel(s), the or each wheel being:

connected or connectable to at least one said body portion; or connectable to said body, the system or kit including at least one component which is connectable to the body through at least one said slot in the body and/or in one or more said body portions or is connected to at least one said body portion through at least one said slot in that/those body portion(s) ("connectable component"), such that the position of a resulting interconnection between the/each connectable component and the body, and thus the location of that component relative to the body, in the assembly is variable along the slot(s) through which that component is connected.

Preferably, the, each or at least one said connectable component comprises a said wheel.

Preferably, the, each or at least one said body portion is configured to define at least one said slot arranged so as to align with said rail or an axis thereof when the trolley is engaged therewith ("axial slot"), whereby the location of a said connectable component connected therethrough is variable in an axial direction or a direction which is in alignment with said rail.

In preferred embodiments of the invention, the/each said slot is formed in a said body portion. However, possible also are embodiments, comprising plural body portions configured to be connected one-to-another and configured with respective sections which together define a said slot when the body portions are so connected.

Preferably, the, each, or at least one said body portion configured to define at least one slot is so configured that the or each connectable component is so connected or so connectable via at least one fastening through the slot(s) along which the location of that component is variable.

Preferably, the each fastening comprises interconnected fastening parts.

Preferably, the/each fastening comprises a connective part, adapted to extend into the slot from one side of the body/body portion(s), a captive part, connected to said connective part and adapted to engage the body/body portion(s) at/on the other side thereof so as to be retained thereby, and a retaining part, which is connected to the connective part to retain the component(s) to the slot/body or said body portion(s), one of the connective part, retaining part and captive part being rotatable or otherwise movable relative to either or each of the other parts in a first sense, to form and/or tighten the fastening, and in a second sense, to loosen and/or disassemble the fastening.

The system or kit may according to one preferred embodiment of the invention is for use in a method of manufacturing the rail trolley in accordance with the first aspect, and includes the system or kit including:

the length(s) of section defining the body portion(s); or section defining integral said body portions, from which said lengths of section can be cut.

According to a fourth aspect of the present invention, there is provided the assembly formed from the system or kit. Preferably the trolley therein accords with the second aspect.

According to a fifth aspect of the present invention, there is provided a rail trolley having a body and wheels mounted to the body to be receivable against a rail such that the trolley engages the rail to be moveable therealong, wherein the body comprises portions ("body portions") which are laterally opposed and to which respective ones of the wheels are mounted to engage proximal parts of opposed laterally outwardly projecting portions of a track section of the rail, thereby restraining the trolley against distal displacement relative to the rail or track section, the assembly being configured with a gap or gaps between said portions and arranged so as to be distal of the projecting portions or track, the trolley or body being configured such that at least one component is connected or connectable thereto:

within at least one said gap; and/or via a mounting within at least one said gap; and/or so as to extend into or within at least one said gap; and/or so as to be arranged within at least one said gap; and/or so as to be wholly or partially accommodated in or by at least one said gap.

Preferably, the rail trolley of said fifth aspect accords with said second aspect.

Preferably, the rail trolley of said fifth aspect is formed from said system or kit.

According to sixth aspect of the present invention, there is provided an assembly comprising said rail trolley or said assembly which comprises a rail trolley;

at least one said component, being so connected.

According to a seventh aspect of the present invention, there is provided a rail trolley having a body and wheels mounted to the body to be receivable against a rail such that the trolley engages the rail to be moveable therealong, wherein the body comprises portions ("body portions") which are laterally opposed and to which respective ones of the wheels are mounted to engage proximal parts of opposed laterally outwardly projecting portions of a track section of the rail, thereby restraining the trolley against distal displacement relative to the rail or track section, the trolley comprising bracing which extends between the laterally opposed body portions so as to restrain them against being pried apart under laterally outward reaction loads exerted on the wheels by the rail.

Preferably, the bracing is at either or each end of the laterally opposed portions.

Preferably, at least one of the laterally opposed body portions is disconnectable from and reconnectable to said bracing such that the body portions are so separable and so reassemblable.

Preferably, the rail trolley of said seventh aspect accords with either or each of said second and fifth aspects.

Preferably, the rail trolley of said seventh aspect is formed from said system or kit.

In preferred embodiments of the invention, said laterally opposed body portions are separable to permit them to be arranged at said opposite lateral sides of the rail and reassemblable when so arranged such that said trolley is in engagement with the rail upon being assembled.

In preferred embodiments of the invention, the body is configured with a gap, extending from one end thereof to the other, which defines or in which there is defined a restriction and which is arranged such that, when the trolley is engaged with the rail, a distal part of the rail projects distally, through the restriction, into the transverse gap whereby the restriction is proximal of a section of the distal part which is wider than the restriction, so as to be received or foul against said section of the distal part in the event of distal displacement of the trolley relative to the rail resulting from failure of said wheels, or one(s) thereof, thereby precluding decoupling of the trolley from the rail.

In preferred embodiments of the invention, the restriction is defined by retainers. The retainers may be defined by said bracing or secured against the bracing member.

According to an eighth aspect of the present invention, there is provided a rail-and-trolley assembly comprising:

a said rail trolley or assembly comprising a rail trolley; and said rail, wherein the trolley engages the rail to be movable therealong.

Preferably, the rail includes a web section/portion arranged proximal of a/said track section of the rail engaged by the trolley/wheel(s) thereof to support the track section. Preferably, the rail also includes a base/base section, flange section or mounting section, arranged proximal of the web/web section, and the web/web section interconnects the base/section and the track section to support the track section from said base/section / flange/mounting section.

According to a ninth aspect of the present invention, there is provided an apparatus including said rail-and-trolley assembly.

BRIEF DESCRIPTION OF THE DRAWINGS

The invention will now be described, by way of non-limiting example only, with reference to the accompanying drawings, in which.

DETAILED DESCRIPTION

Figure 1:
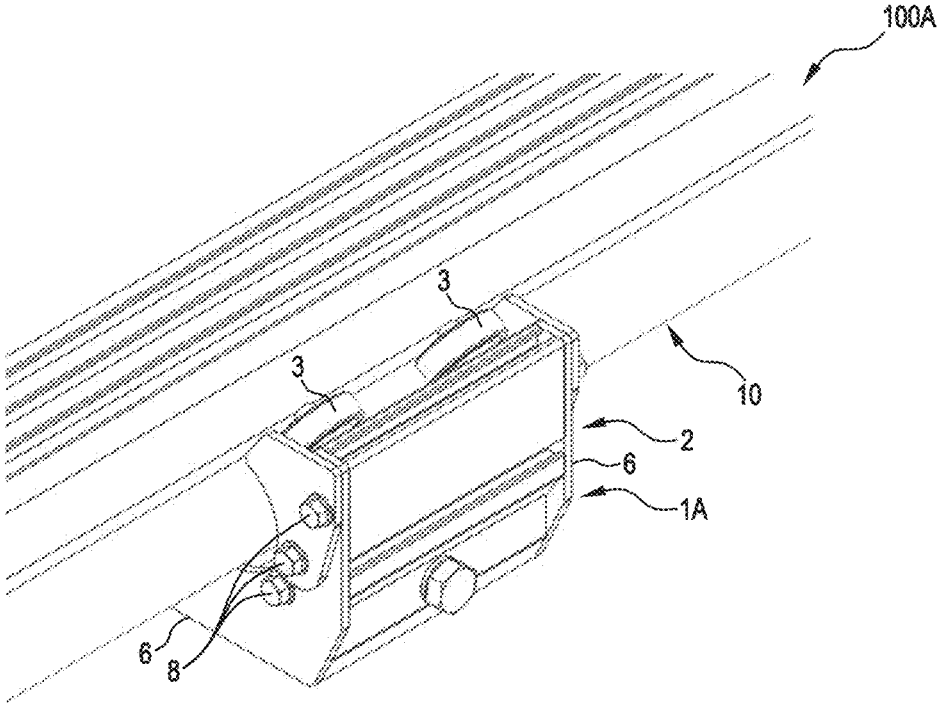
FIG. 1 is a perspective view of a trolley track system, comprising a rail and a trolley engaged therewith to be movable therealong, in accordance with a first preferred embodiment of the present invention.
Figure 2:
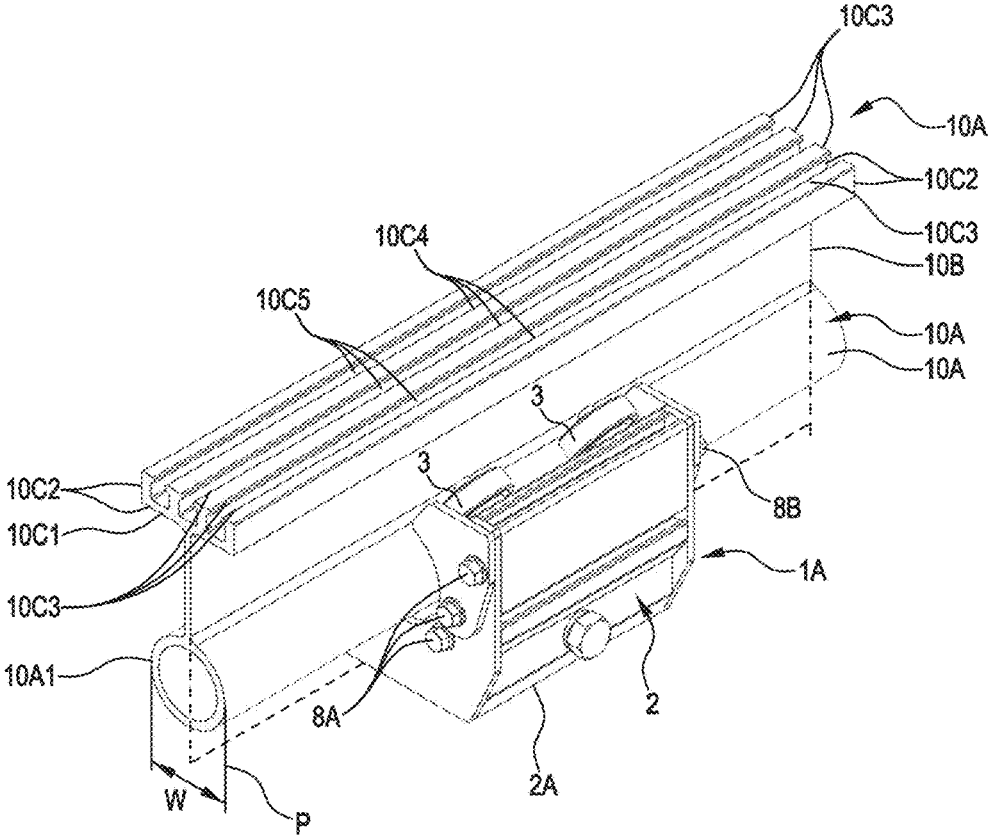
FIG. 2 is a perspective view corresponding to FIG. 1 and showing a cross-sectional configuration of the rail.

Shown in FIGS. 1 and 2 is a trolley-and-rail assembly 100A which comprises a trolley 1A and a rail 10 which the trolley 1A engages to be movable therealong. The rail 10 is defined by a length of extruded section (typically aluminum or steel) and comprises a track or rail portion or section 10A, a web portion 10B and a flange section 10C, the web portion 10B extending between a proximal part of the rail section 10A and the flange section 10C. The flange section 10C, rather than being configured in the form of a plate, comprises a plate portion 10C1 which is arranged perpendicular to the web portion 10B and from which that web portion projects, spaced apart web portions 10C2 which project upwardly from the plate portion 10C1, and toes or lips 10C3 projecting laterally inwardly from upper ends of laterally outermost ones of the portions 10C2 and projecting both laterally inwardly and laterally outwardly from uppermost ends of the remaining, laterally inner, portions 10C2. The portions 10C1, 10C2 and 10C3 define cavities 10C4 and slots 10C5 through which the respective cavities 10C4 can be accessed. The cavities 10C4/slots 10C5 can be utilised for mounting—of the rail to a structure/component which supports it (whereby section 10C defines a base of the rail) and/or of componentry to the rail 10, as will be apparent from the disclosure which follows.

The track section 10A is configured such that opposed portions 10A1 thereof project laterally outwardly from a central plane P of the web 10B. In the present embodiment, the rail portion 10A is of substantially circular cross-section, whereby the lateral portions 10A1 are substantially semi-circular in cross-section.

The rail 10 as shown in the drawings is straight, such that the track section 10A is configured in the form of a hollow cylinder which extends along and is centred about the plane P. However, the rail 10, including the track section 10A, web 10B and flange section 10C may be curved, about either or each of vertical and horizontal axes, whereby the translational path followed by the trolley therealong is non-linear.

Figure 7:
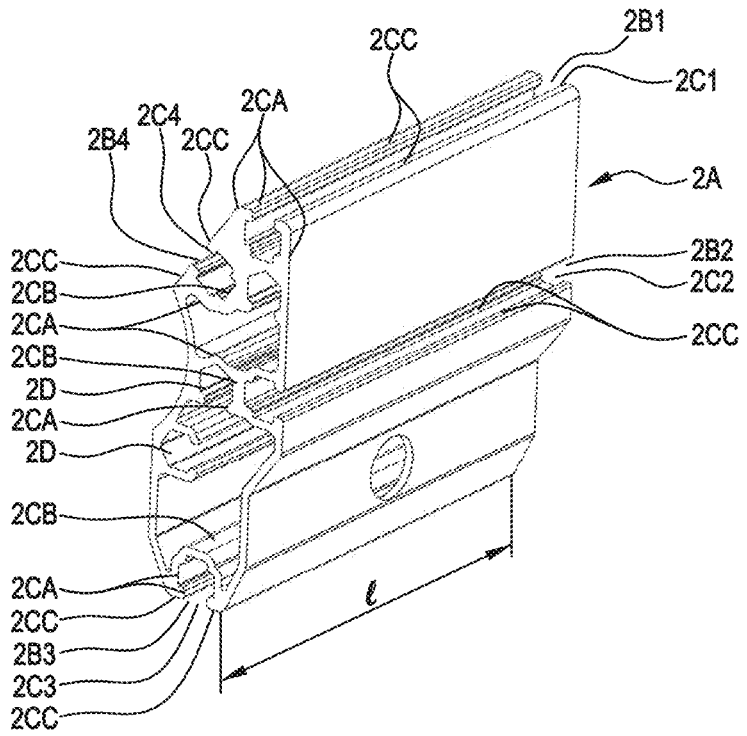
FIG. 7 is a perspective view showing cross-sectional details of one of opposed body portions of the trolley of any of the aforementioned embodiments.
Figure 8:
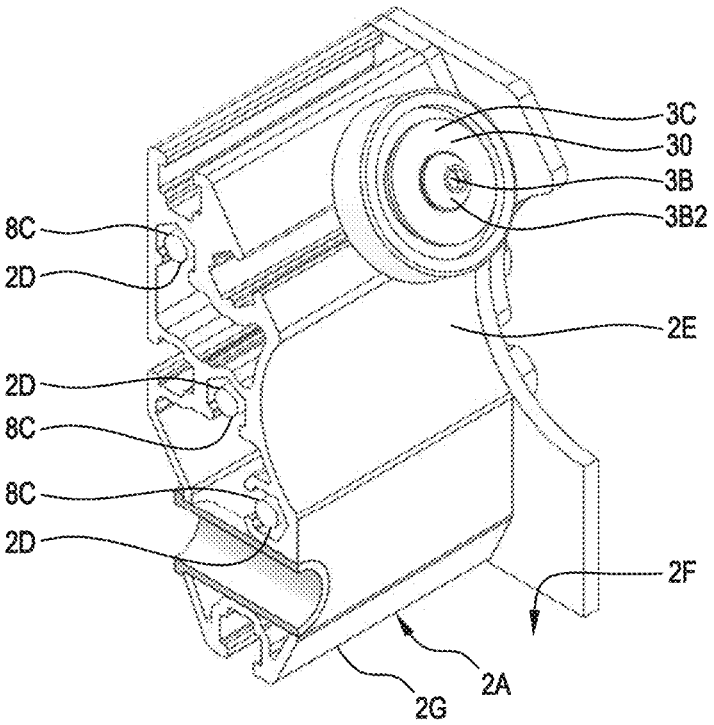
FIG. 8 is a cut away cross-sectional view showing part of a said body portion, a wheel of the trolley mounted to that portion, part of a gusset which connects the body portion to an opposing such portion in the trolley, one of opposing retainers, which is mounted to the gusset/body portion, and elongate fastenings which secure the gusset and retainer to the body portion.

Referring additionally to FIGS. 7 and 8, the trolley 1A has a body 2 and wheels 3, mounted to the body 2, to engage the track section 10A, the positions of the wheels 3 with respect to the body being adjustable, as described later below. The body 2 comprises opposed body portions 2A (see in particular FIG. 7), each of which is defined by or comprises extruded section provided in a length 1 corresponding to a required or appropriate length L of the body 2 or trolley 1A. To that end, either/each portion 2A can be extruded to the length 1, or cut in length 1, from a longer section so extruded.

The body portions 2A are interconnected in laterally opposed relation such that each is arranged to a respective lateral side of the plane P. To that end, the trolley 1A/body 2 comprises gussets or brackets 6 each of which is secured at a respective one of opposite ends of the body portions 2A, the gussets 6 defining bracing which restrains the body portions 2A from being pried apart under laterally outward reaction loads exerted by the portions 10A1 on the wheels 3 and transmitted by the latter to the body portions 2A.

Each gusset 6 comprises a bridge portion 6A, extending from one side of the plane P to the other, and opposed arm portions 6B each of which projects from a respective one of opposed ends of the bridging portion 6A and is secured to the respective body portion end, the portion 6A and 6B defining a gap 6C within the trolley 1A, which gap accommodates the rail portion 10C and web 10B.

The trolley 1A/body 2 further includes retainers 7, each of which includes a mounting portion 7A received and secured against a respective one of the arm portions 6B, and a projecting portion 7B, arranged to project laterally inwardly whereby a gap 7C, defined between that portion and the laterally inwardly projecting portion 7B of the retainer 7 laterally opposite to it, receives therein the web 10B and/or proximal part of track portion 10A is of a width w less than a width W of the track portion 10A. The or each of the laterally opposed retainers 7 at either or each end, in the event of failure of the trolley 1A, especially as resulting from damage to/breakage of wheels 3, will be received/foul against the portion 10A and thus preclude separation of the trolley 1A from the rail 10 under gravity.

The trolley 1A further includes fastenings 8 to secure the gussets 6 to the body portions 2A, and the retainers 7 against the respective arm portions 6B. The fastenings 8 are described in further detail later below.

Figure 3:
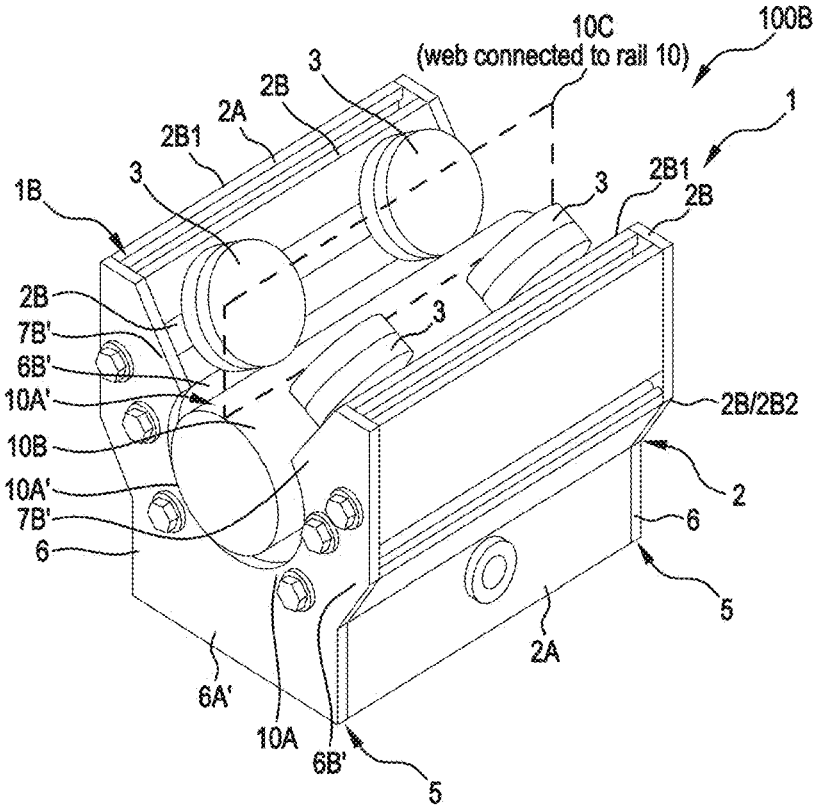
FIG. 3 is a perspective view showing details of a trolley track system, comprising a variant of the trolley and a variant of the rail, in accordance with a second preferred embodiment of the invention.
Figure 4:
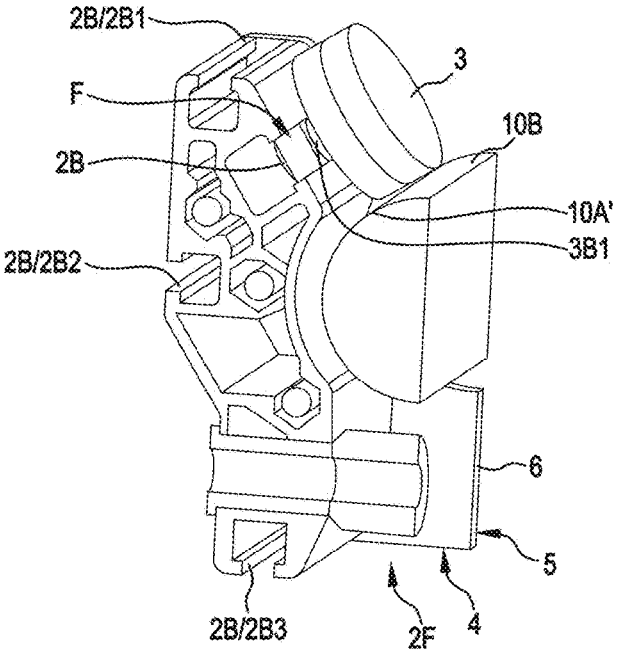
FIG. 4 is a cut away cross-sectional view showing details of the trolley and rail illustrated in FIG. 3.

FIGS. 3 and 4 show details of an assembly 100B, also embodying the invention, which is the same as assembly 100A with the trolley (1B) thereof is configured such that its gussets/brackets (6) are configured with laterally inwardly projecting portions (7B'), which perform the same function as the portions 7B though are integral with the remainders of the respective gussets/brackets 6' (but which is otherwise identical to trolley 1A). The rail of assembly 100B is preferably rail 10, though shown in FIGS. 3 and 4 is a possible variant of the rail, namely rail 10', the track or rail portion (10A') of which is solid instead of being a tubular/hollow. The rail 10', shown as a substitute for rail 10 of the assembly 100B, can likewise, without departure from the invention, be a substitute for the rail 10 in any of the other embodiments described herein with.

The body portions 2A are identical in cross-sectional configuration, though the orientation of one about an upright axis is opposite to the orientation of the other about that axis. Referring especially to FIG. 7, each body portion 2A is extruded, such as from aluminum or steel, and is tubular, so as to be relatively lightweight and such that the volume of material of which it is composed is relatively small. The body portion 2A is configured with slots, generally designated "2B", the slots comprising an upwardly opening slot 2B1, a laterally outwardly opening slot 2B2, a downwardly opening slot 2B3 and an upwardly and laterally inwardly opening slot 2B4. In the illustrated embodiments, such slots are arranged at upper, laterally outer, lower and upper/laterally inner positions, respectively, on the body portion 2A, though in other embodiments of the invention, any of these positions may differ. The body portion 2A is configured with elongate cavities 2C1, 2C2, 2C3 and 2C4, into which the slots 2B1, 2B2, 2B3 and 2B4, respectively, open, whereby the former are accessible through the latter. Each of the cavities, which are generally designated "2C", is defined by opposed side wall portions 2CA and a proximal wall portion 2CB from which the portions 2CA extend, and toes or lips 2CC projecting laterally inwardly from distal ends of the portions 2CA (whereby respective ones of the slots 2B are defined therebetween).

Figure 21:
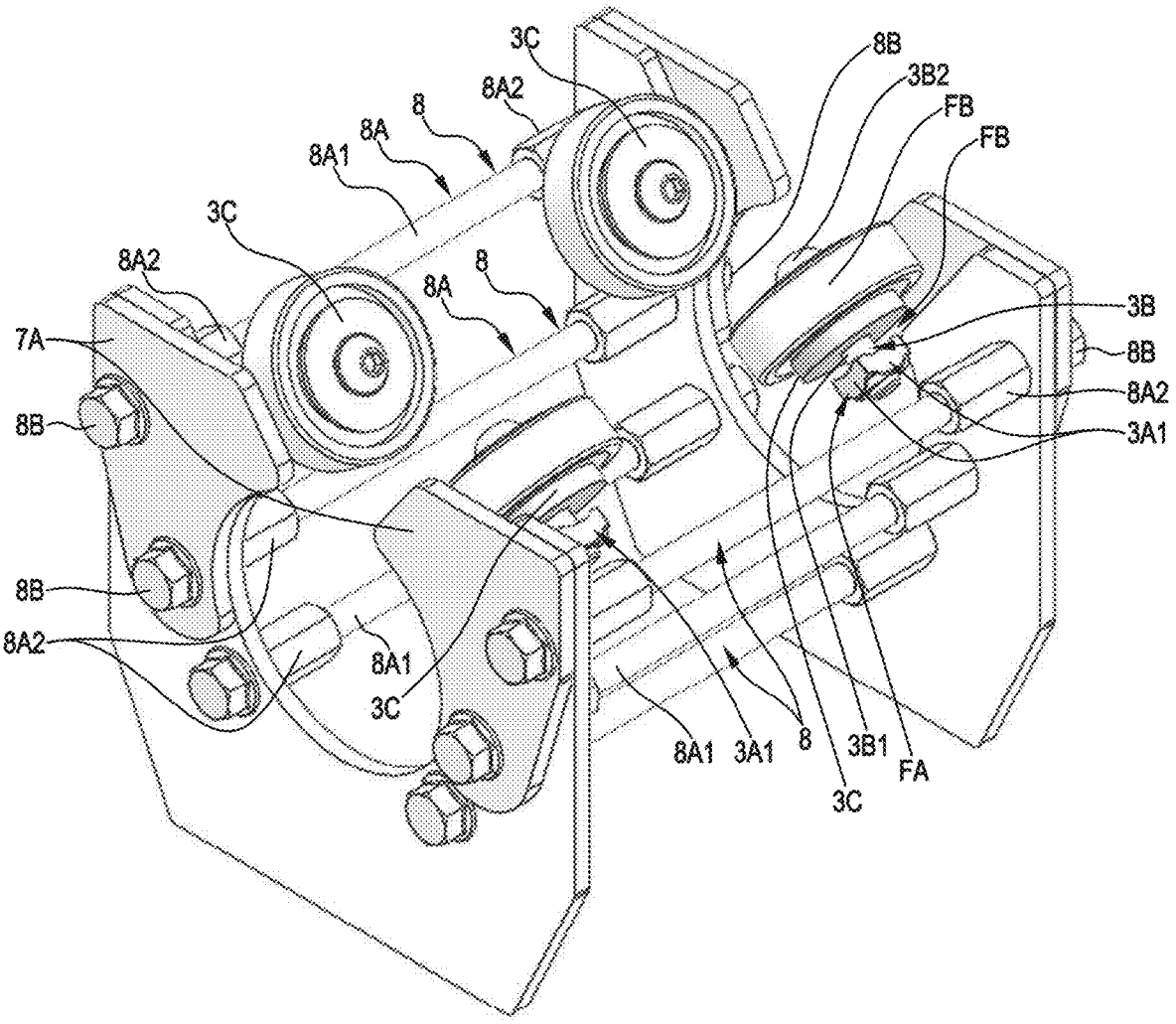
FIG. 21 is a perspective view showing details of the trolley according to the first, third or fourth embodiment with body portions thereof omitted to show a support structure or skeleton of the trolley, comprising opposed gussets and elongate fastenings which interconnect them, as well as the opposed retainers, secured to the gussets, and wheel assemblies, of each of which a respective said wheel forms a part.

In each of the embodiments described with reference to the drawings, defined by each slot 2B and the respective cavity 2C into which it is a respective channel Each body portion 2A is additionally configured with internal channels, generally designated "2D", each of which is defined by opposed side wall portions 2DA, having parallel faces, divergent proximal wall portions 2DB, from respective outer/distal ends of which the portions 2DA extend, and toes or lips 2DC which project convergingly from outer/distal ends of the side wall portions 2DA, each have a face which is parallel with the face of a respective, diametrically opposed, one of the proximal wall portions 2DB. Each channel 2D thus conforms in cross-section to a hexagon. Referring to FIG. 21, each fastening 8 comprises an elongate section 8A, each of which comprises an elongate member 8A1, e.g. being a length of threaded rod, and opposed elongate nuts 8A2 screwed onto respective threaded ends of the member 8A1, and opposed bolts 8B, the leading end of each of which is screwed into a respective one of the nuts 8A2. Each channel 2D receives the elongate section 8A of a respective one of the fastenings 8 and is sized such that the nuts 8B of that section fit snugly therein, resulting abutment between respective opposed faces of each nut 8B and the channel 2D precluding rotation of the elongate section 8A about its longitudinal axis. Each of the bolts 8B of each fastener 8 is received through a respective mounting hole in the gusset 6 at the end of the body 2 at which that bolt is located, whereby that gusset 6 is clamped between the head 8B1 of the bolt and the end face of the body portion 2A at/adjacent said end. The mounting portions 7A of the retainers 7 are configured with mounting holes through which the shanks of respective ones of the bolts 8B that extend through arm portions 6A are received, such that the fastenings 8 of which those bolts form a part additionally secure the retainers 7 to/against the gussets 6 (such that the heads 8B1 of those bolts abut the gussets 6 indirectly).

Without departure from the invention, said elongate section of each fastener could comprise a length of hexagonal-section bar (likewise snugly received in respective channel 2D), configured at opposite ends thereof with threaded holes, to receive the shanks of bolts 8B, or a rivet nut in place of the threaded rod interconnection. Other rotatably interlocking channel and nut/bar cross-sectional configurations, including for example a square cross-sectional configuration, and are, of course, possible without departure from the invention.

Each body portion 2A is also configured with a concave wall portion 2E conforming with a respective lateral portion 10A1 and arranged to lie adjacent, though clear of, that portion.

Owing to the provision of the slots 2B, various components, be they part of the trolley 1A or supplementary/additional to it, are mountable or connectable, through such slots, to either body portion 2A at selectable and variable positions therealong. Such components ("connectable components") include wheel assemblies 30, of each of which a respective one of wheels 3 forms a part. Referring also to FIG. 21, each assembly 30 comprises, in addition to wheel 3, one or more bearings (not shown), over which the wheel 3 is fitted, and thrust washers 3C to either side of the bearing(s). Each wheel assembly 30 is secured against, so as to be mounted to, a body portion 2A via a loosenable/releasable fastening F, comprising a captive part FA, defined by a nut 3A in the embodiments illustrated, receivable behind slot 2B (specifically, slot 2B4 in the illustrated embodiments comprising wheel assemblies 30), so as to be trapped in the cavity 2C associated therewith (2C4 in the illustrated embodiments) and a connective part FB which extends through the slot 2B and is connected to captive part FA, the connective part FB in the embodiments illustrated being defined by a bolt or screw 3B, and comprising the shank 3B1 thereof, which also extends through the thrust washers 3C in the present embodiment, and also through the bearing(s), and receives the captive part FA/nut 3A thereover at the free/leading end thereof, the head 3B2 of which bolt or screw is received against the outer thrust washer 3C and defines a retaining part FC of the fastening F. The captive part/nut 3A is configured with opposed portions 3A1 which lie closely adjacent or in contact with respective faces defined by sidewall portions 2CA such that each is precluded from rotating in the cavity 2C4 when the head 3B2 is engaged by a tool (such as an allen key, screwdriver or spanner, depending on the configuration of the head 3B2) and turned so as to tighten the fastening F—whereby the connectable component (that component being the wheel assembly 30 in the present case), specifically a face thereof (being the inner face of the inner thrust washer 3C in the present case) is urged tightly against a body portion 2A (usually directly though possibly indirectly, e.g. through a washer or other element interposed between it and the body portion 2A), particularly portions 2CC thereof, which portions are thus clamped between the captive part FA and said face, such that frictional engagement between the portions 2CC and either or each of said face and the captive parts/element precludes movement of the connectable component along the slot 2B—or to loosen the fastening F—whereby said face is no longer urged against the body portion 2A or portions 2CC and the latter thus are not clamped between the captive part FA and said face, so that there is insufficient such frictional engagement and the connectable component can thus be moved along the slot 2B. As will be appreciated by a person skilled in the art, the fastening may instead comprise a bolt or screw the head of which is configured with said opposed portions and received in cavity 2C4 (thus defining the captive part, instead of the nut or another captive element doing so) and the shank of which extends through the slot 2B4 (as well as through the bearings and thrust washers 3C), thus defining said connective part, and a nut or other element/part (e.g. a threaded part/portion/element of the connective component/wheel assembly 30) received over the leading end of the bolt shank, against the outer thrust washer 3C, and rotatable (e.g.using a tool such as a socket, screwdriver or spanner, depending on the configuration of the nut/element) to loosen or tighten the fastening, thus defining the retaining part.

Figure 5:
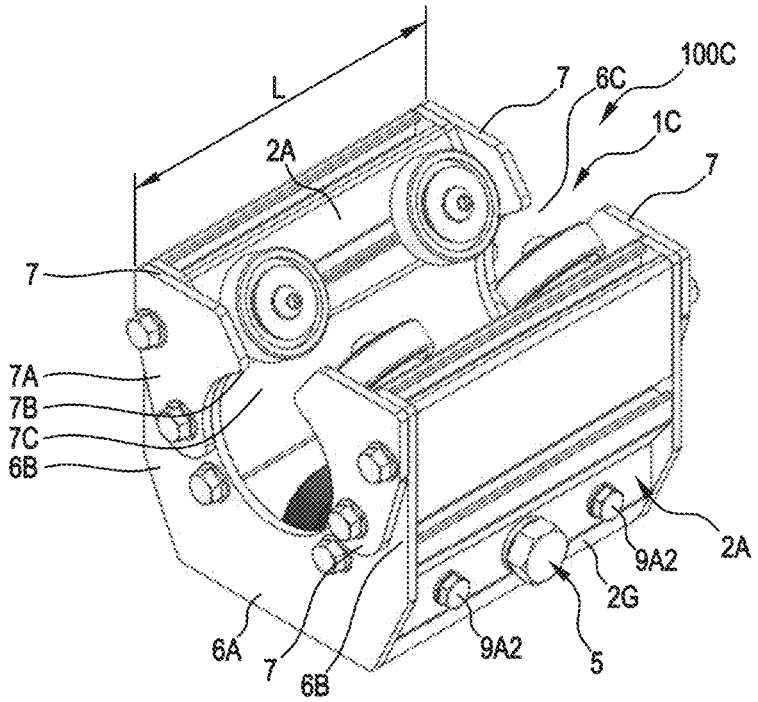
FIG. 5 is an upper three-quarter view of a trolley according to a third preferred embodiment of the present invention.
Figure 6:
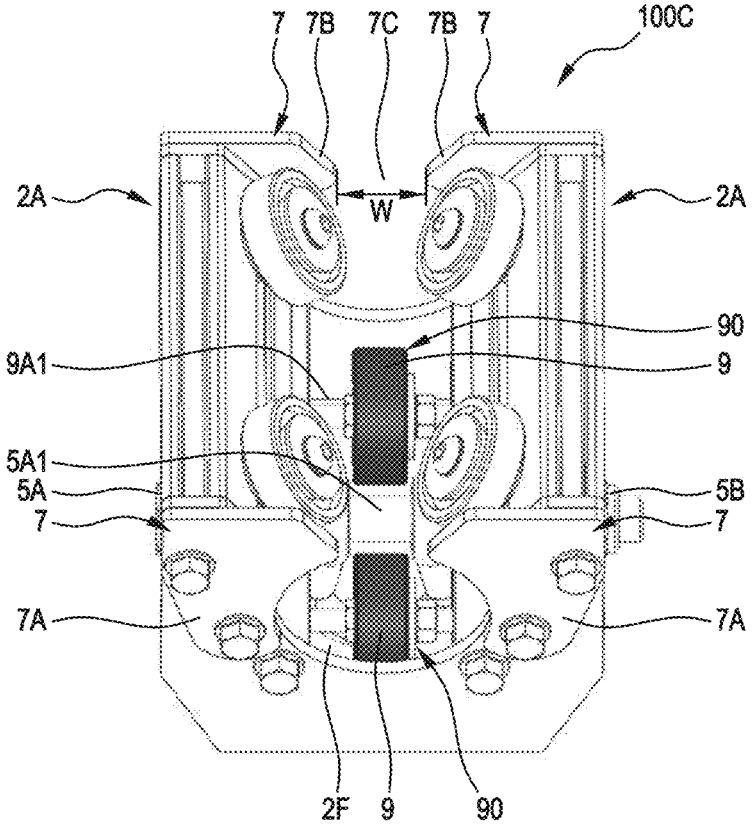
FIG. 6 is an upper end perspective view of the trolley shown in FIG. 5.

The body portions 2A are configured such that a gap 2F (see FIGS. 4 and 8) is defined between the sections 2G thereof arranged distally of the track portion 10C ("distal sections"). Advantageously, the gap 2F can be utilised to accommodate, wholly or partially, componentry which is part of and/or supplementary/additional to the trolley, whereby the space occupied by the trolley, or the resulting trolley assembly comprising that trolley and said componentry, is less than that which would be so occupied were the componentry/part thereof to be exterior to the body 2/body portions 2A, in particular distal of the distal sections 2G, and/or the componenty is arranged/mounted closer to the rail than it otherwise would be (as may be important particularly in low headroom applications). A further advantage of components being accommodated in the gap 2F is that they can be shielded by the body 2/body portions 2A and thus protected from damage. Referring to FIGS. 5 and 6, in trolley 1C, which accords with a further preferred embodiment of the invention, such componentry comprises wheels 9 arranged to engage distal part/portion of the track portion 10C and to cooperate with the wheels 3 to preclude translational displacement of the trolley 1C transverse to the track portion 10C ("distal wheels"). The trolley 1C is the same as trolley 1A though comprises pairs of aligned mounting holes in the distal sections 2G and wheel assemblies 90 ("distal wheel assemblies"), of each of which a respective one of the wheels 9 forms a part, each assembly further comprising a bolt 9A, the shank 9A1 of which extends through a respective pair of mounting holes, thereby extending across and within the gap 2F, a bearing (not shown) received over the shank within the gap and over which the wheel 9 is fitted, and a nut 9B screwed onto the leading end of the bolt 9A (opposite to the end at which a head 9A2 of the bolt 9A is provided), the shanks 9A1 defining shafts of which the respective wheels 9 are mounted.

Without departure from the invention, the distal wheel assemblies may instead be configured to be mounted, at opposite ends thereof, through slots 2B3, by way of connections therethrough similar to those via which the wheel assemblies 30 are mounted through slots 2B4—in which case, they are likewise adjustable in position along the body 2/body portion 2A.

The track section/rail portion 10C/10C' of the rail 10/10' may, without departure from the invention, have alternative cross-sectional configurations defining the opposed lateral portions thereof—e.g. any of various elliptical cross-sectional configurations. That said, the circular cross-sectional configuration thereof is especially conducive to the trolley having an ability to rotate, to an extent, about a central axis of the rail portion/circle to which it conforms. The trolley's being able to rotate about the central axis is particularly advantageous where a load to be supported by the trolley is to be capable of displacement in a plane perpendicular to the axis and/or where lateral/torsional loads borne or transmitted through the trolley and/or rail are to be minimised/substantially eliminated. An example of an application embodying the invention, in which the load is to be capable of such displacement, and in which it is often desirable that such loads be so minimised/eliminated, is a repelling/abseiling system in which the abseiling rope/cable is hung from the trolley—e.g. a high-rise building window washing system—in which the rail extends horizontally and parallel to a face to be repelled against (being a face of the high-rise building, comprising windows to be washed, in the example mentioned). Owing to the trolley's ability to rotate about the axis, swinging of the rope/cable, caused by a person using the system pushing off the face to repel downwardly or sideways, is about that axis rather than the interconnection between the rope/cable and the trolley, eliminating lateral loading in the trolley and torsional loading in the trolley which would otherwise be caused, and facilitating swinging/providing for ease of movement. Another such example is a system/arrangement in which a load is suspended from the trolley, in a manner such that it has little or no ability to pivot sideways relative to the trolley, and the rail has a bend about a vertical axis, whereby the path of the trolley/load is non-linear, wherein movement of trolley around the bend subjects the suspended load to a centripetal force, towards the vertical axis—which force, owing to the ability of the trolley to rotate about the central axis and the suspended load thus to swing outwardly, is imparted from the rail through to the suspended load without the rail and the trolley/suspended load being subjected to torsional and lateral loads, respectively, which loads would be especially significant if the trolley is travelling quickly, the bend has a small radius of curvature or the load is long in the vertical direction and/or heavy, and would tend to pry the trolley off the rail and/or the rail off the structure(s) from which it is supported.

Other componentry part of and/or supplementary/additional to the trolley 1A/1B/1C can be wholly or partially accommodated by the gap 2F, including componentry via which equipment and/or other componentry to be supported from the trolley/rail is connected to the body 2/body portions 2A, including, for example, shackles, locking pins/mechanisms, drive wheels, and a rack-and-pinion arrangement (described later below).

Referring to FIGS. 5 and 6, showing a rail-and-trolley assembly 100C, the trolley 1C of that assembly (as does each of the trolleys 1A and 1B in the assemblies 100A and 100B, respectively) includes a fastener 5 which interconnects the distal sections 2G, the fastener 5 comprising a bolt 5A, the shank 5A1 of which (see FIG. 6) extends through aligned mounting holes in the distal sections 2G/body portions 2A so as to extend across and within in the gap 2F and a nut 5B screwed onto the leading end thereof. The fastener 5 defines a mounting point or one or more mounts (hereinafter, "mounting point"), at which any of various items can be mounted to the trolley, such items including, for example, hoists, fall arrest lanyards or static structures (like the frames in the arrangement shown in FIG. 15, discussed later below). It will be appreciated that plural such mounting points may be provided and that the mounting point(s) may be defined by different features/componentry without departure from the invention. Owing to the central location of the mounting point(s) with respect to the body 2 and wheels 3, weight is distributed evenly between the wheels 3.

Figure 9:
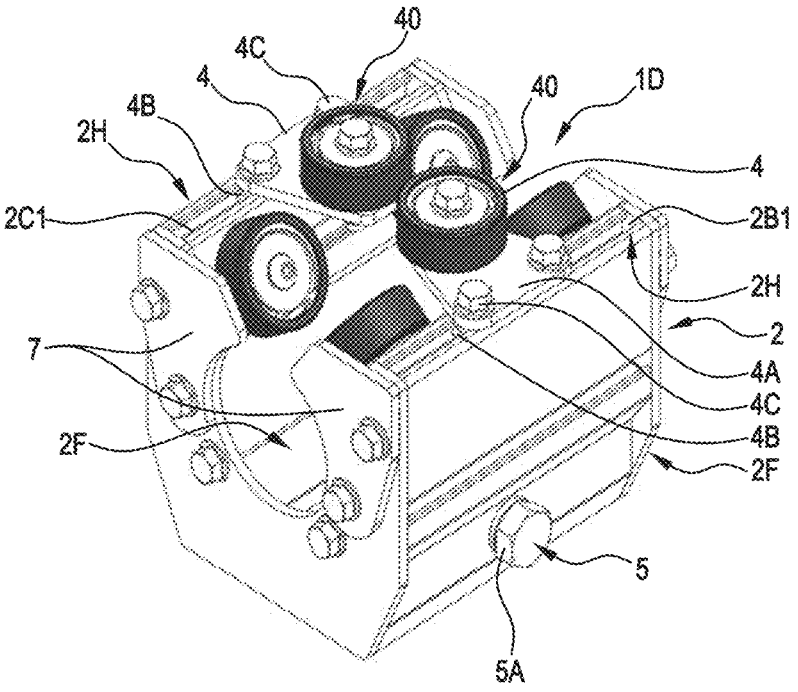
FIG. 9 is an upper three-quarter view of a trolley according to a fourth preferred embodiment of the invention.

Shown in FIG. 9 is a trolley 1D according to a further preferred embodiment of the invention, this trolley being the same as trolley 1A though additionally comprising wheel assemblies 40 connected to proximal sections 2H of the body portions 2A. Each wheel assembly 40 ("proximal wheel assembly"), being another example of a said connectable component, comprises a wheel 4 ("proximal wheel") arranged to be received against a respective one of the sides/side faces of web 10B and a support member 4A, defined by a bracket or plate in the present embodiment, to a distal end of which the wheel 4 is rotatably mounted. Each assembly 40 is secured against, so as to be mounted to, a body portion 2A via a said loosenable/releasable fastening F, comprising captive part FA (defined by a nut 4B, having the same configuration as the nut described above and illustrated in FIG. 21), receivable behind slot 2B (specifically, slot 2B1 in the present embodiment), so as to be trapped in the cavity 2C associated therewith (2C1 in the present embodiment) and connective part FB which extends through the slot and is connected to captive part FA, and receives the captive part FA/nut 4B thereover at the free/leading end thereof, the connective part FB being defined by a bolt or screw 4C, and comprising the shank thereof, the head of that bolt or screw being received against the outer face of the support 4A. The captive part FA/nut 4B is precluded from rotating in the cavity 2C1, in the same manner as the nut 3A is precluded from rotating in cavity 2C4, when the head is engaged by a tool (such as an allen key, screwdriver or spanner, depending on the configuration of the head) and turned so as to tighten the fastening F—whereby the connectable component (that component being the assembly 40 in the present case) specifically a face thereof (being the inner face of the support member 4A in the present case) or a face is urged tightly against a body portion 2A, particularly portions 2CC thereof, which portions are thus clamped between the captive part FA and said face, such that frictional engagement between the portions 2CC and either or each of said face and the captive part/element precludes movement of the connectable component along the slot 2B(1)—or to loosen the fastening F—whereby said face is no longer urged against the body portion 2A or portions 2CC and the latter thus are not clamped between the captive part FA and said face, so that there is insufficient such frictional engagement and the connectable component can thus be moved along the slot 2B1. As will be appreciated by a person skilled in the art, the fastening, again, may instead comprise a bolt or screw the head of which is configured with said opposed portions and received in cavity 2C1 (thus defining the captive part) and the shank of which extends through the slot 2B1 (as well as through the plate 4A), thus defining said connective part, and a nut or other element/part (e.g. a threaded part/portion/element of the connective component/wheel assembly 40) received over the leading end of the bolt, against the outer face of the plate 4A, and rotatable (e.g. using a tool such as a socket, screwdriver or spanner, depending on the configuration of the nut/element) to loosen or tighten the fastening. As will be, again, appreciated by a person skilled in the art, each fastening may instead comprise a bolt or screw the head of which is configured with said flats and received in a said cavity 2C1 (thus defining a captive portion constituting the captive part) and the shank of which extends though the slot 2B1 and through the mounting holes of the bracket 4A (thus defining a said connective portion, which extends through the slot) and a nut or other threaded element which is received over the leading end of the bolt and against the bracket 4A and is rotatable (e.g. using a tool such as a socket, screwdriver or spanner) to loosen or tighten the fastening.

Figure 11:
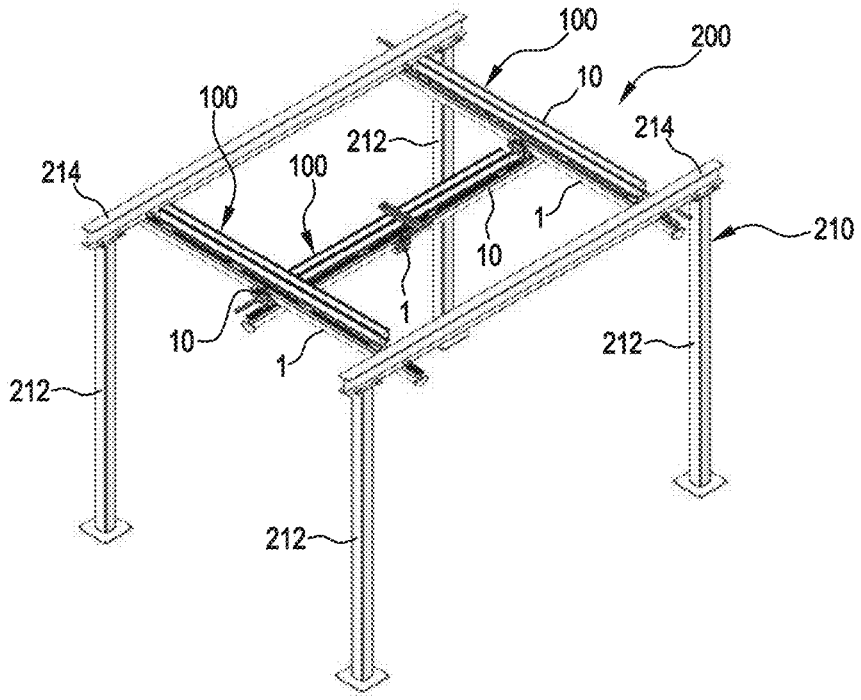
FIG. 11 is a perspective view of a gantry crane, comprising trolley-and-rail assemblies, in accordance with one embodiment of the present invention.
Figure 15:
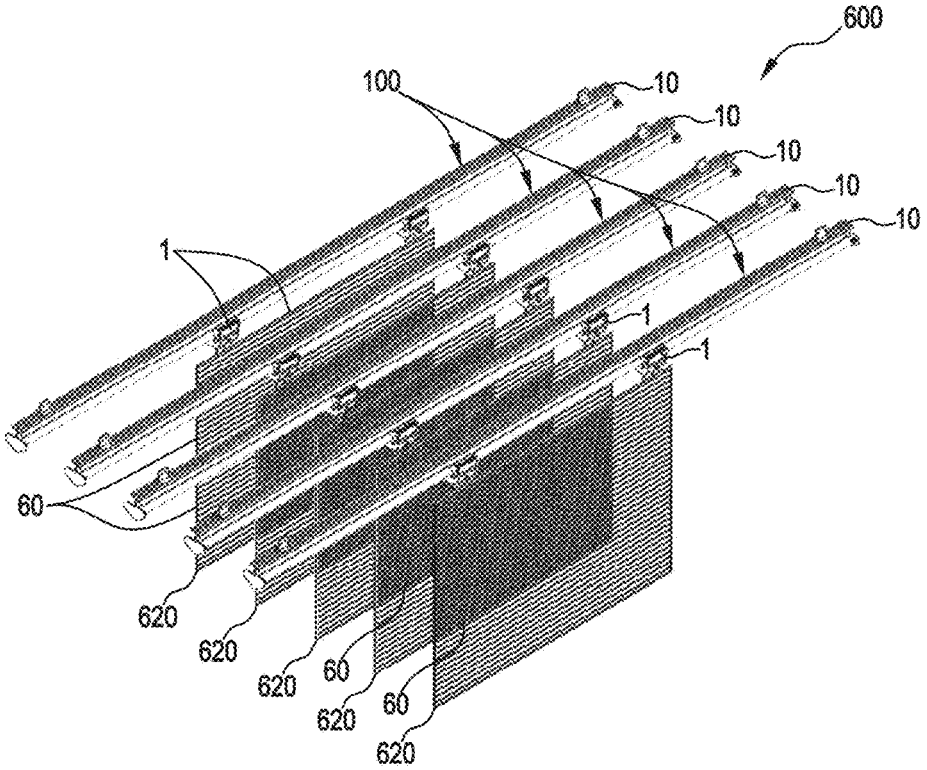
FIG. 15 is a perspective view of storage apparatus including rail-and-trolley assemblies in accordance with a further preferred embodiment of the invention.
Figure 22:
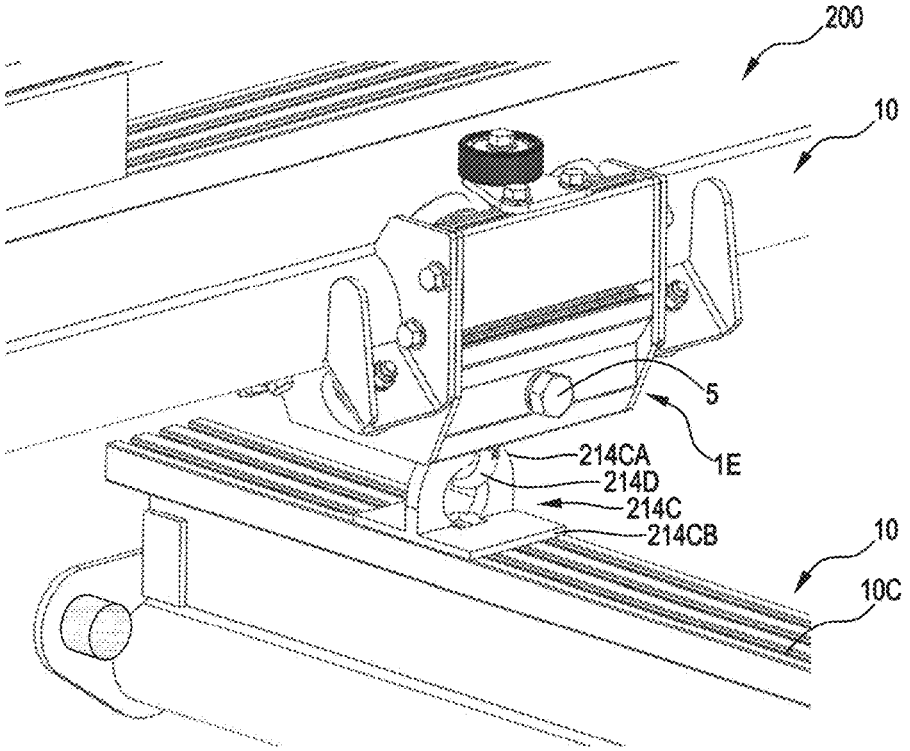
FIG. 22 is an upper, laterally inner perspective view showing the trolley of said fifth embodiment as the trolley mounted to each of parallel fixed rails in the gantry crane of FIG. 11, and details of an interconnection between the trolley and a transverse rail of the crane whereby the transverse rail is mounted to the trolley to be movably supported from the fixed rail.
Figure 23:
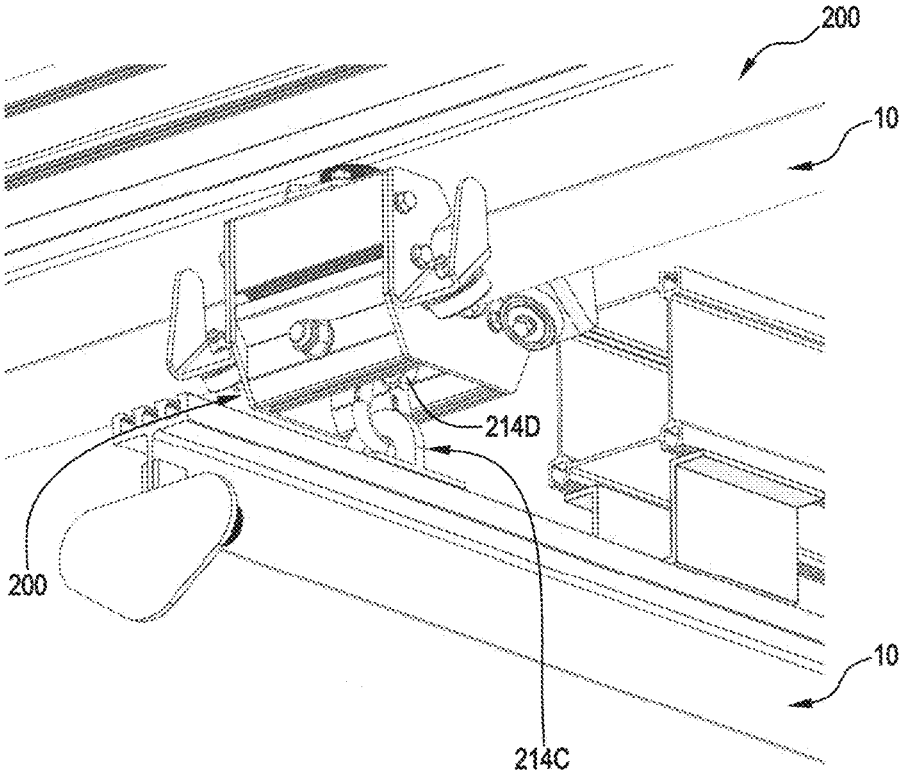
FIG. 23 is a lower, laterally outer perspective view of the mounting shown in FIG. 22.

The proximal wheels 4 can be either spaced slightly from the web 10B, whereby upon rotational displacement of the trolley about the central axis of the track portion 10C/10C' to a sufficient extent, one or the other of them (depending on the direction of the rotational displacement) is received against that web, thereby limiting the degree to which such rotation is permitted, or instead in contact with the web 10B, whereby any such rotation is precluded (as may be important, to accommodate any unintended or inadvertent side loading, e.g. in the case of the fixed rail-and-trolley assemblies in the gantry crane shown in FIGS. 11, 22 and 23 and in the case of frames in the arrangement shown in FIG. 15, discussed later below). If appropriate, a plurality of such assemblies 40 can be mounted to either or each body portion 2B, through a respective slot 2B1 thereof. Each wheel assembly 40 is another example of a said connectable component.

Figure 10:
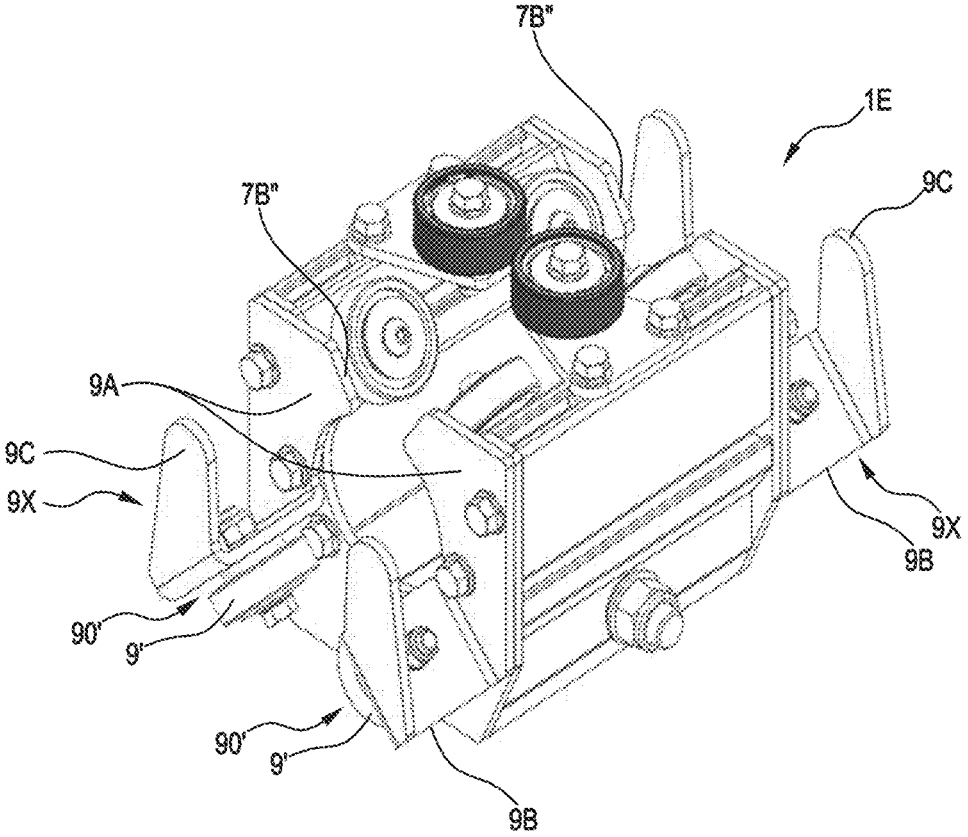
FIG. 10 is an upper three-quarter view of a trolley according to a fifth embodiment of the present invention.

Shown in FIG. 10 is a trolley 1E according to a further preferred embodiment of the invention, this trolley being the same as the trolley 1D but comprising, instead of retaining brackets 7, supplementary assemblies 90', each of which comprises a bracket 9X which includes a mounting portion 9A received and secured against a respective one of the arm portions 6B, a wheel-supporting portion 9B projecting axially from portion 9A in a direction away from the body portion 2A, and a lug portion 9C, projecting proximally from the distal end of portion 9B. Each mounting portion 9A is configured with mounting holes so as to be securable against the respective arm portion 6B in the same manner as retainer 7, and is configured with a laterally inwardly projecting portion (7B"), which performs the same retaining function as the portions 7B and 7B'. The assemblies 90' further comprise wheels 9' rotatably mounted to the respective portions 9B and arranged to engage, at each axial end of the trolley 1E, respective distal parts of the opposed lateral portions 10A1. The wheel assemblies 90' and the wheels 9' thereof thus define distal wheel assemblies and distal wheels, respectively, which are axially outwardly arranged and may be alternative or additional to wheel assemblies 90 and the wheels 9 thereof, respectively. The wheels 9' provide torsional stability to the trolley 1E, e.g. where the trolley 1E and rail form part of a gantry crane (discussed below with reference to FIGS. 22 and 23), preventing it from jamming against the (horizontally extending) rail when subjected to torsional loading about a vertical axis. The wheels 9' may also prevent the trolley 1E from jamming if subjected to an unintended uplift or compression load. Another embodiment of the invention which includes the trolley 1E is a dumbwaiter or dumbwaiter lift, i.e. a small freight elevator or lift, comprising the rail arranged to extend vertically, rather than horizontally. Such a dumbwaiter/dumbwaiter lift may include a support, such as one which supports food/dishes (e.g. a tray) in a restaurant application of the dumbwaiter/dumbwaiter lift, through which support moment loads about a horizontal axis are imparted to the trolley 1E.

Shown in FIG. 11 is a gantry crane 200, being an example of an apparatus which incorporates rail-and-trolley assemblies embodying the invention. The gantry crane 200 includes a frame 210 which comprises, at each of opposed ends thereof, laterally spaced uprights 212, lower ends of which are receivable (and, if appropriate, securable) against a floor surface, and a beam 214 interconnecting the upper ends of the uprights 212. The crane 200 further comprises opposed rails 10 ("long-travel rails"), each of which is secured at/adjacent opposite ends thereof to the beams 214 at/adjacent a respective lateral side of the frame 210, and respective trolleys 1 mounted to the rails 10 each rail 10 and the trolley 1 (the numeral "1", as used herein, indicating that the trolley to which it refers may be any trolley as described herein and with reference to the drawings, including any of trolleys 1A to 1E as and where appropriate) mounted to it thus defining a rail-and-trolley assembly, generally designated "100". The crane 200 further comprises a transverse rail 10 ("cross-travel rail") which extends perpendicular the long-travel rails and is connected, at opposite ends thereof, to the trolleys 1 mounted to those rails, whereby the cross-travel rail which is so connected is movable in a direction parallel to the axis of the long-travel rails 10. The crane further includes a trolley 1 mounted to the cross-travel rail 10 so as to be movable therealong, and appropriate lifting componentry mounted to the trolley—e.g. connected to it through slots 2B thereof and/or within gap 2F therein. The cross-travel rail 10 and the trolley 1 mounted thereto together define a transverse trolley-and-rail assembly 100.

It will often be preferable that each of the respective trolleys 1 mounted to the long-travel rails 10 be trolley 1E, as shown in FIGS. 22 and 23, owing to the specific characteristics of the wheel assemblies 40 and 90 thereof, which are outlined above. The interconnection/coupling via which the transverse (lowermost) rail 10 is mounted to trolley lE includes a bracket 214C having an eye 214CA and a base, in the form of a flange 214CB, which is connected to the flange section 10C of the transverse rail 10 (e.g. in a manner similar to that in which the flange 314CA is secured to flange section 10C in the jib crane 300, discussed later below with reference to FIG. 12). The interconnection/coupling further includes a shackle 214D connected at a lower end thereof to eye 214CA and at an upper end thereof to mounting point 5 within the body 2. The connection between the cross-travel rail 10 and (each) each trolley 1E is thus a floating one, allowing the cross-travel rail to move up and down as it travels along the long-travel rails, whereby it is not prone to jamming—even if not perpendicular to either long-travel rail 10.

Mounting holes may, as and where appropriate, be drilled into flange section 10C to receive fastening bolts such that a secure connection to the flange section 10C/rail is ensured.

Figure 12:
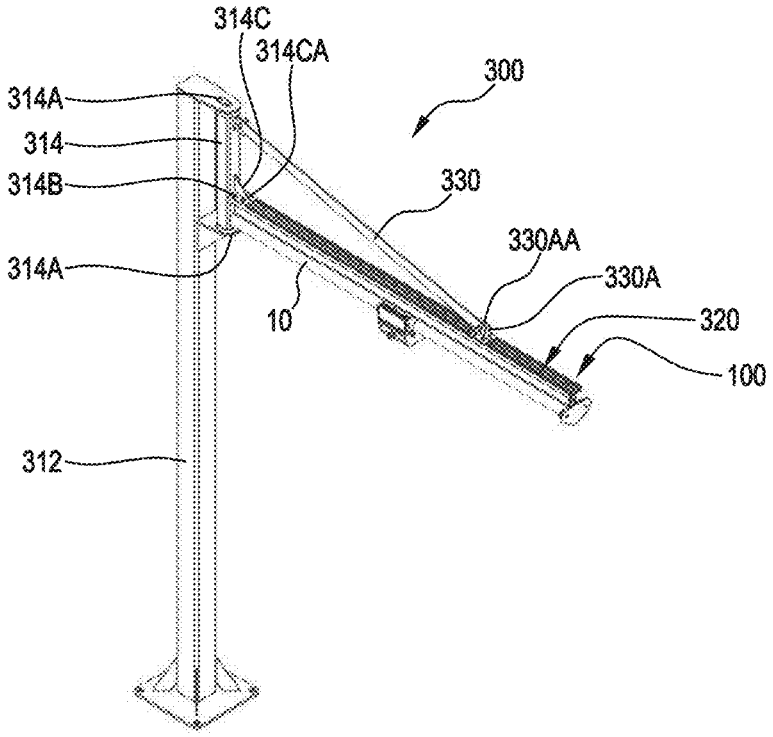
FIG. 12 is a perspective view of a crane including a trolley-and-rail assembly, in which a jib of the crane comprises the rail, in accordance with another preferred embodiment of the invention.

Shown in FIG. 12 is a jib crane 300, being another example of an apparatus incorporating a trolley-and-rail assembly 100, in accordance with a further preferred embodiment of the invention. The jib crane 300 comprises a mast 312, securable at a lower end thereof against a support surface—e.g. a floor surface or a face of structural member in a frame structure—and an arm or boom 320, comprising rail 10, connected at a proximal end thereof to an upper end section of the mast 312 via a pivotable mounting 314, which mounting comprises vertically spaced brackets 314A, attached to or integral with the mast 312, and a rotatable member 314B opposite ends of which are rotatably mounted to respective ones of the bracket 314A. The mounting includes a bracket 314C connected (e.g. welded) to the member 314B and including a flange 314CA configured with mounting holes therethrough, each of which receives a shank of a bolt or screw that extends through a respective mounting hole in flange 314CA and a respective one of slots 10B4, the bolt/screw forming part of a respective fastening F, the shank of which defines connective part FB, which fastening additionally comprises a said captive part FA received non-rotatably in a respective one of cavities 10C4 (behind a respective slot 10B4) and over the free/leading end of the shank.

The crane 300 further comprises a diagonal brace 330 one end of which is connected to an upper end section of member 314, and the other end of which is connected to the rail, via a bracket 330A which, likewise, includes a flange 330AA configured with mounting holes therethrough, each of which receives a shank of a bolt or screw that extends through a respective mounting hole in flange 330AA and a respective one of slots 10B4, the bolt/screw forming/defining part of a respective fastening F, wherein the shank defines connective par FB and the captive part FA of is received (non-rotatably) in a respective one of cavities 10C4 (behind a respective slot 10B4).

Figure 13:
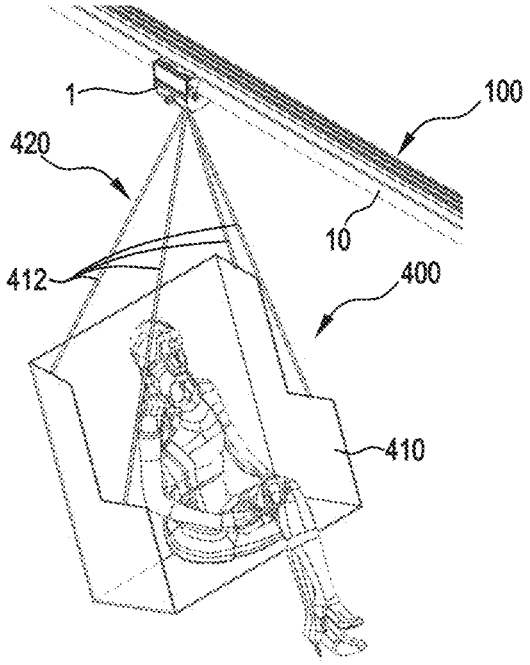
FIG. 13 is a perspective view of an overhead suspension system, for carrying a person, which includes a rail-and-trolley, in accordance with another preferred embodiment of the invention.

Shown in FIG. 13 is an overhead suspension viewing apparatus 400, incorporating a rail 10 and trolley 1 (of which a said rail-and-trolley assembly 100 is comprised), in accordance with a preferred embodiment of the invention The apparatus 400 includes a person-supporting component 410, typically a chair seat (as illustrated) or a body harness, and a connecting arrangement 420, .g. comprising cables 412, via which the chair/seat, harness or other supporting component is suspended from the trolley 1.

Figure 14:
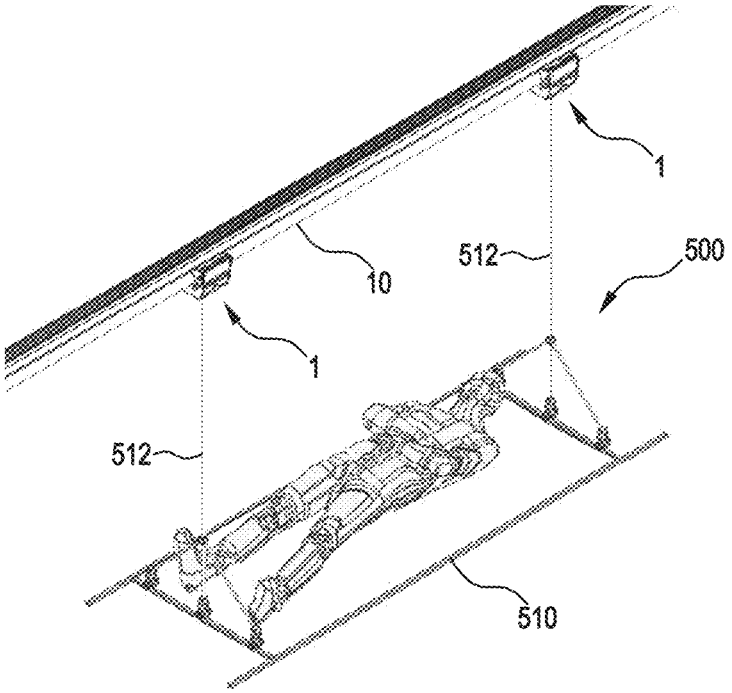
FIG. 14 is a perspective view of a patient moving & handling apparatus including a rail-and-trolley assembly in accordance with another preferred embodiment of the invention.

Shown in FIG. 14 is a patient handling, moving and/or transporting apparatus 500, incorporating a rail 10 and spaced apart trolleys 1, in accordance with a preferred embodiment of the invention. The apparatus 500 includes a patient-supporting component 510, typically a stretcher, bed device or sling, and a connecting arrangement 520—e.g. comprising cables 522 via which the patient-supporting component 510 is suspended from the trolley 1.

Shown in FIG. 15 are details of a storage apparatus 600, including rail-and-trolley assemblies 100 in accordance with a further preferred embodiment of the invention, wherein each assembly 100 comprises a rail 10 and one or more (typically two) trolleys 1 (preferably trolley(s) 1E, as mentioned above) mounted thereto, as well as a mount 620, connected to the trolley(s) 1 (such as via a mounting point in the gap 2F as previously mentioned) to depend therefrom and to support one or more items 60 (e.g. comprising picture frames). The apparatus 600 may comprise, for containing the mounts 620/items 60, a compartment or respective compartments (not shown) within, into, or over and in alignment with, which the rails 10 extend such that the mounts 620 are housed by the compartments when in the positions shown in FIG. 15 (whereby items 60 are stored therein) and are accessible upon the trolley pair being moved, along the rail 10, to be at/adjacent an end, or either end, of the rail 10, such that item(s) 60 can be mounted to it or dismounted from it. Alternatively or additionally, the/each compartment enterable by a person such that item (s) 60 can be mounted to or dismounted from the mounts 620.

Figure 16:
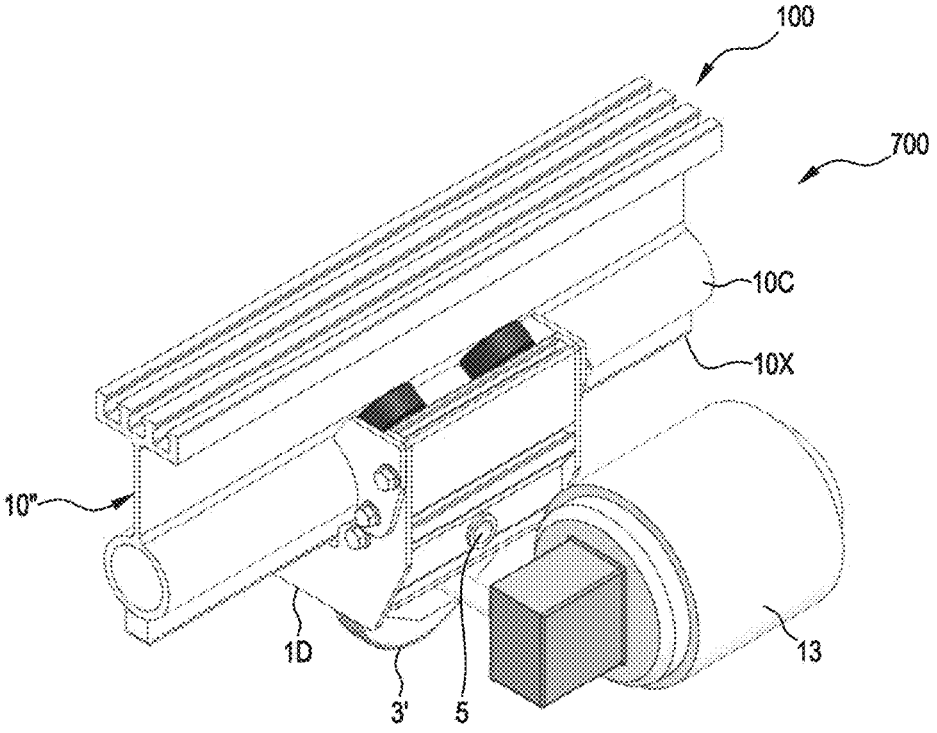
FIG. 16 is a perspective view showing details of a rail-and-trolley assembly in which the rail is provided with a rack and the trolley is provided with a pinion, meshed with the rack, and a motor to drive the pinion such that the trolley moves along the rail, in accordance with a further embodiment of the invention.

Shown in FIG. 16 is an apparatus comprising a rail-and-trolley assembly 100, in which the rail (10") is includes a rack 10X, which can be described as extending along and projecting distally from portion 10A or as a part of section 10A and projecting distally from portions 10A1, and in which trolley 1 (e.g. trolley 1D) comprises a wheel 3', which is configured as a pinion (intermeshed with the rack 10X)

and is mounted, in the gap 2F at a mounting point (as previously described). The trolley 1 includes or is provided with a motor 13, typically electric, which is coupled to the pinion 3' to drive rotation thereof, such that the trolley 1D moves along the rail 10". A bracket or other support (not shown) is mounted through either/each bottom slot 2B3 (preferably at least the bottom slot 2B3 on the motor side of the trolley), via a fastening of the kind previously described, to support the drive shafts and shaft bearings in the motor/drive train arrangement of this embodiment. Also, a bracket or other support (likewise not shown) is mounted through either/each slot 2B2 (preferably at least the slot 2B2 on the motor side of the trolley) to support the drive motor. The/each mounting point could be the shank 5A1 of bolt 5A of a said fastener 5 that interconnects the distal sections 2G, the shank extending through aligned mounting holes in the distal sections 2G/body portions 2A so as to extend across and within the gap 2F, that fastener including and a nut 5B screwed onto the leading end of the shank 5A1. However, it may be appropriate that the mounting point(s) be defined by an alternative arrangement, in which case fastener 5 could be omitted. Without departure from the invention, the trolley may comprise one or more wheels frictionally, rather than meshingly, engaging the rail 10/portion 10A/10', and be provided with or comprise a said motor which drives rotation of the wheel(s) so engaging the rail 10/portion 10A/10'.

Figure 17:
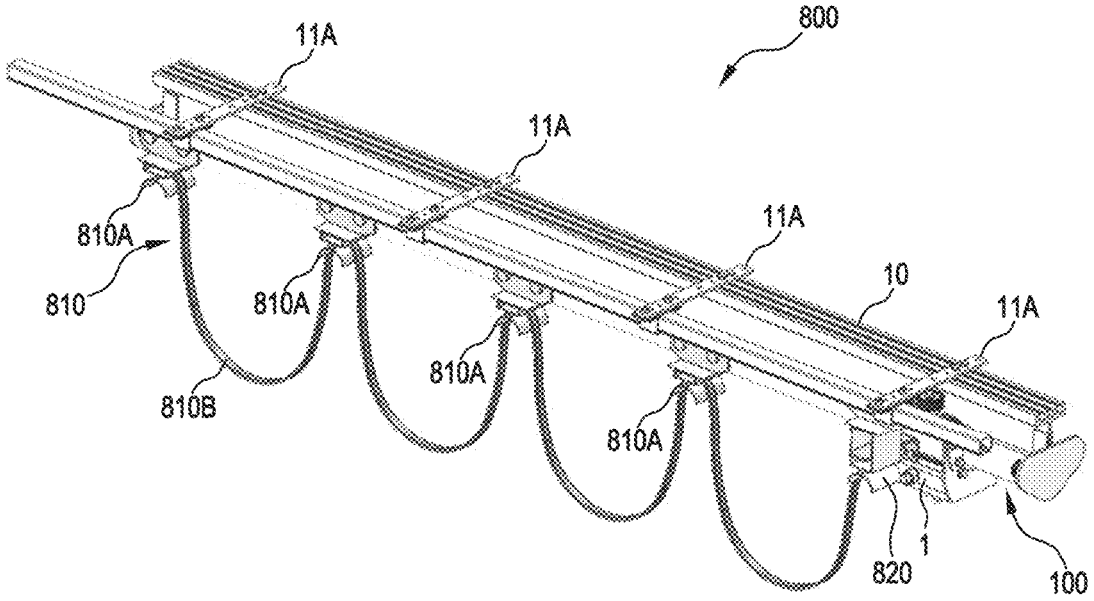
FIG. 17 is a perspective view showing an apparatus comprising a trolley-and-rail assembly and, mounted to that assembly, a festoon assembly, including festoon connected to the trolley, in accordance with a further preferred embodiment of the invention.

Shown in FIG. 17 is an apparatus 800 including a rail-and-trolley assembly 100, comprising rail 10 and trolley 1 (mounted thereto), and a festoon assembly 810, which assembly comprises brackets 810A, slideably or otherwise axially moveably mounted to the rail 10, or to a separate rail 11 mounted thereto via brackets 11A (in which case the rail 11 and brackets 11A form a part of the apparatus 800), at spaced positions therealong, cabling 810B (comprising one or more cables) supported from the brackets 810A, and unit 820 mounted to the trolley—eg via a fastening of a kind as previously described (extending through a slot 2B2)—via which unit the trolley 1 will typically receive a utility provided by the cabling (e.g. electrical power or a fluid, such as compressed air or oil). The brackets 810A are slidably mounted to the rail 10 or 11 to be able to move therealong, as the trolley 1 moves along the rail 10.

Figure 18:
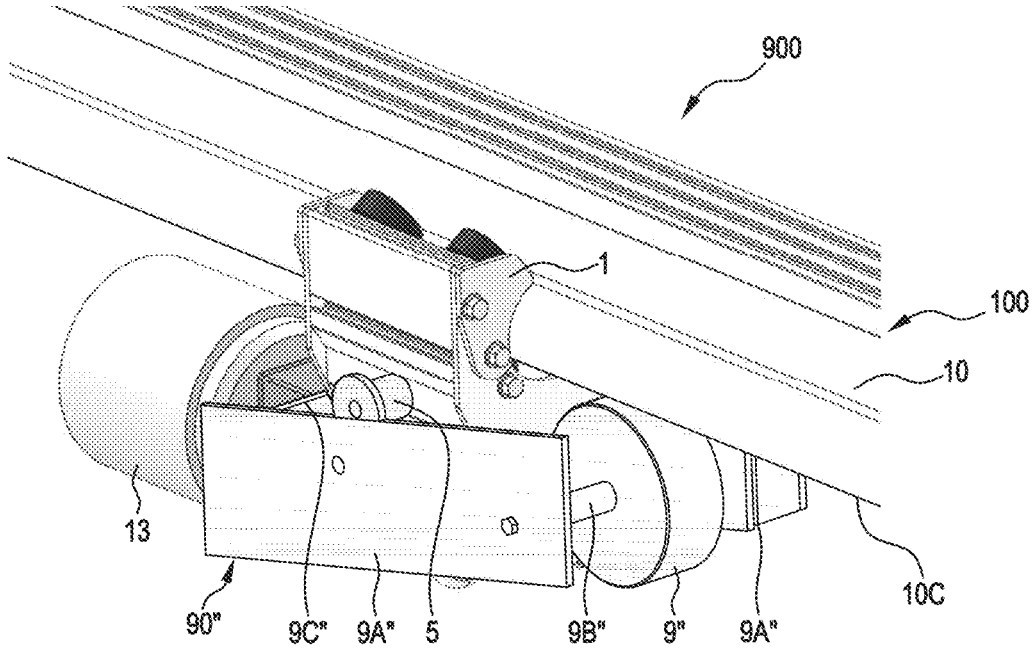
FIG. 18 is a perspective view of a rail-and-trolley assembly, including a powered trolley, in accordance with yet another preferred embodiment of the invention.

Shown in FIG. 18 is an apparatus 900 comprising a rail-and-trolley assembly 100, a motor 13, typically electric, which is mounted to or forms part of trolley 1, and a load-mounting-and-driven wheel assembly 90" pivotably mounted to the body 2, via a said mounting point 5 (which is mounted through said mounting holes in the body portions 2A, such that the pivot axis thereof extends within and across gap 2F, part of the mounting being accommodated in gap 2F). The assembly 90" comprises laterally opposed support members 9A", wheel 9" rotatably supported from the members 9A" (via a shaft 9B" extending between them in the example shown) at a position forward of the mounting 5/body 2 and, more particularly, forward of a vertical plane in which the pivot axis lies. The assembly 90" further comprises a mount 9C" extending between members 9A", to be supported therefrom, at a position rearward of said vertical plane, to which mount 9C" a load is connectable, to hang from the mount 9C"/trolley 1/apparatus 900 (typically via a hoist), such that it imparts to the assembly 90" a moment about the pivot axis which acts to press the wheel 9" against the distal part of the track portion 10C, with a force proportional to the weight of the suspended load. The frictional engagement between the wheel 9" and said distal part, and therefore the degree of traction between the wheel 9" when driven and the track portion 10C, thus corresponds to said weight (being proportional to that weight where the applicable coefficient of friction is constant), so that the wheel 9" will not be excessively pressed against the track portion 10C when the load is light or insufficiently pressed (so as to slip) against the track portion 10C when the load is heavy. Thus, whereas the apparatus 800 comprises or defines a positive drive system (owing to the intermeshing rack and pinion), the apparatus 900" comprises or defines a friction drive system via which a proportional tractive effort is offered by the weight/dead mass of the load, the assembly 90" therein comprising or defining a friction drive unit of the friction drive system.

Figure 19:
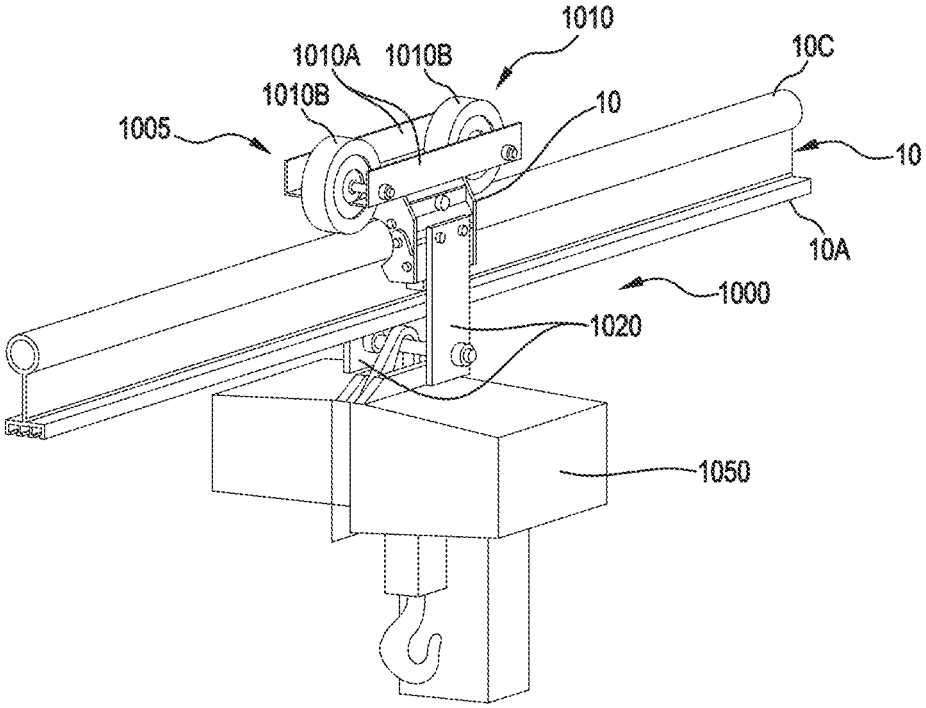
FIG. 19 is a perspective view of a monorail crane, comprising a trolley-and-rail assembly and a powered hoist supported from the trolley therein, in which the rail assumes and alternative orientation.

As will already be clear from the foregoing, the rail 10 can assume different orientations without departure from the invention. FIG. 19 shows a crane or other lifting/handling apparatus 1000 according to a further embodiment of the invention, in which the rail 10 is orientated such that portion 10C thereof is uppermost and flange section 10A thereof is lowermost. Apparatus 1000 includes a trolley assembly 1005 which comprises trolley 1 (mounted to rail 10) and a wheel assembly 1010, having laterally opposed wheel-supporting members 1010A connected through respective distal slots 2B1 (being the uppermost ones of the slots in the case of this embodiment, given the inverted orientation of the rail 10), via fastenings as previously described, and wheels 1010B each of which is rotatably mounted to the supports 1010A and received against the distal (and in this case uppermost) portion of the section 10C. The apparatus 1000 further includes a hoist apparatus 1050 and connectors, comprising brackets 1020, each of which is connected at an upper end thereof to a respective one of the body portions 2A, through slot 2B2 thereof, via one or more fastenings of a kind previously described, and is connected at a lower end thereof to the hoist apparatus 1050.

Figure 20:
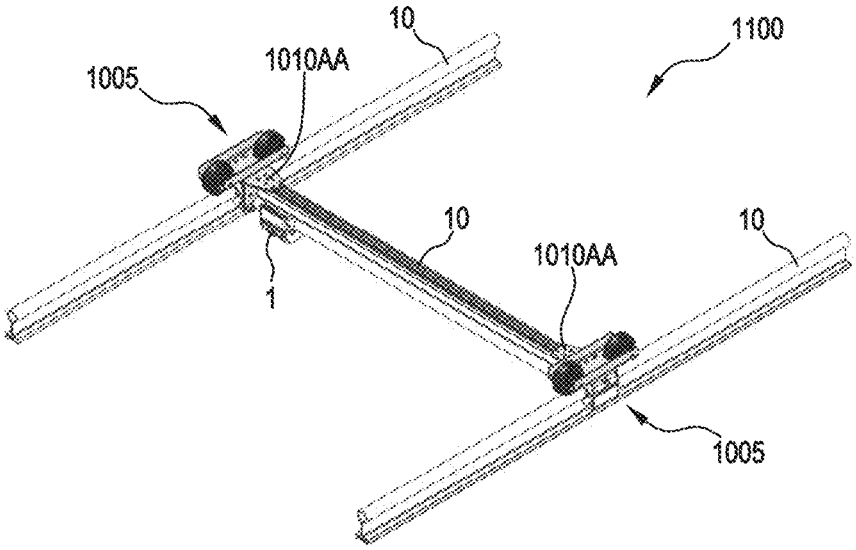
FIG. 20 is a perspective view showing details of a gantry crane comprising opposed trolley-and-rail assemblies, in each of which the rail assumes the alternative orientation, and a further trolley-and-rail assembly the rail of which is secured to the trolleys of the opposed assemblies.

Shown in FIG. 20 are details of a gantry crane 1100 comprising opposed trolley assemblies 1005, parallel rails 10 to which they are mounted (each of those rails likewise assuming an inverted orientation) and a transverse rail 10 which extends perpendicular to parallel rails 10 and is connected, at opposite ends thereof, to the trolleys 1 of assemblies 1005 mounted to those rails, whereby the transverse rail is movable in a direction parallel to the axes of the parallel rails 10. Connection between each end of the transverse rail 10 and the respective trolley 1 is effected by fastenings F each of which comprises a captive part FB received in a respective one of cavities 10C4, a captive part FB received in cavity 2C3, and an interconnecting part FA, which extends through slots 10C5 to connect the captive elements/portions/parts to respective brackets 1010AA, each forming part of or being interconnected with a respective one of the assemblies 1005. The crane 1100 further includes a trolley 1 mounted to the transverse rail 10 so as to be movable therealong.

While various embodiments of the present invention have been described above, it should be understood that they have been presented by way of example only, and not by way of limitation. It will be apparent to a person skilled in the relevant art that various changes in form and detail can be made therein without departing from the spirit and scope of the invention. Thus, the present invention should not be limited by any of the above described exemplary embodiments.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference in this specification to any prior publication (or information derived from it), or to any matter which is known, is not, and should not be taken as an acknowledgment or admission or any form of suggestion that that prior publication (or information derived from it) or known matter forms part of the common general knowledge in the field of endeavour to which this specification relates.

The invention claimed is:

1. A system for forming an assembly which comprises a rail trolley that has a body and one or more wheels mounted to the body to be receivable against a rail such that the trolley engages the rail to be moveable therealong, the system comprising:

at least one body portion which said body comprises or is to comprise, the, each, or at least one said, body portion being configured to define at least one slot in said body; and said wheel(s), the or each wheel being:

connected or connectable to at least one said body portion; or connectable to said body, the system including at least one connectable component which is connectable to the body through at least one said slot in the body and/or in one or more said body portions or is connected to at least one said body portion through at least one said slot in that/those body portion(s), such that a position of a resulting interconnection between the or each component and the body, and thus a location of that component relative to the body, in the assembly is variable along the slot(s) through which that component is connected, wherein the, each or at least one said body portion is configured to define at least one said axial slot arranged so as to align with said rail or an axis thereof when the trolley is engaged therewith, whereby the location of said connectable component connected therethrough is variable in an axial direction or a direction which is in alignment with said rail.

2. The system according to claim 1, wherein the, each or at least one said connectable component comprises any one or more of a said wheel, a bracket, a mounting, and a unit, device or apparatus (which unit, device or apparatus may be connected or connectable to at least one line for providing a utility to the trolley or apparatus so as to mount the line(s) to the body).

3. The system according to claim 1, wherein the, each or at least one said body portion is configured to define at least one said axial slot arranged to open upwardly therein and/or in the body, at least one said axial slot arranged to open laterally therein and/or in the body, at least one said axial slot arranged to open laterally outwardly therein and/or in the body, and at least one said axial slot arranged to open downwardly therein and/or in the body.

4. The system according to claim 1, being such that the or each said wheel of the trolley is receivable against a proximal part of a track section of the rail, restraining the trolley against distal displacement relative to the rail or track section, and wherein the, each or at least one said body portion is configured to define any one or more of at least one said axial slot arranged to open therein and/or in the body in a direction which is proximal relative to the section portion or rail when the trolley is engaged therewith, at least one said axial slot arranged to open therein and/or in the body in a direction which is distal relative to the track section or rail when the trolley is engaged therewith, and at least one said axial slot arranged to open therein and/or in the body in a direction which is lateral relative to the track section or rail in that body portion and/or in the body when the trolley is engaged therewith.

5. A system for forming an assembly which comprises a rail trolley that has a body and one or more wheels mounted to the body to be receivable against a rail such that the trolley engages the rail to be moveable therealong, the system comprising:

at least one body portion which said body comprises or is to comprise, the, each, or at least one said, body portion being configured to define at least one slot in said body; and said wheel(s), the or each wheel being:

connected or connectable to at least one said body portion; or connectable to said body, the system including at least one connectable component which is connectable to the body through at least one said slot in the body and/or in one or more said body portions or is connected to at least one said body portion through at least one said slot in that/those body portion(s), such that a position of a resulting interconnection between the or each component and the body, and thus a location of that component relative to the body, in the assembly is variable along the slot(s) through which that component is connected, wherein the, each, or at least one said body portion configured to define at least one slot is so configured that the or each connectable component is so connected or so connectable via at least one fastening through the slot(s) along which the location of that component is variable.

6. The system according to claim 5, wherein the, each, or at least one said body portion configured to define at least one slot is so configured that the or each connectable component is so connected or so connectable via said fastening(s) comprised of:

a connective part adapted to extend, into the or each said slot along which the location of that component is variable, from one side of the body or said body portion(s) defining that slot; and a captive part connected to said connective part and adapted to engage the body or said body portion(s) at or on the other side thereof so as to be retained thereby.

7. The system to claim 6, said captive part being adapted to be positioned at said other side to be urged against the body or said body portion(s), whereby said connectable component(s) connected by the fastener comprising that captive part and the connective part to which it is connected is/are axially fixed relative to the slot(s) along which the location(s) thereof is/are variable, preferably owing to resulting frictional engagement between the said captive part and the body or said body portion(s) against which it is urged, and wherein the, each, or at least one said body portion configured to define at least one slot is configured to define therein/in said body at least one cavity into which a said slot defined thereby opens and in which the captive part of the or each said fastening through the slot is received/and or engages the body or said body portion(s) defining the slot, preferably the cavity being wider than the slot and the captive part being transversely wider than the slot.

8. The system according to claim 5, being such that the or each said wheel of the trolley is receivable against a proximal part of a track section of the rail, restraining the trolley against distal displacement relative to the rail or track section, and wherein the, each or at least one said body portion is configured to define any one or more of at least one said axial slot arranged to open therein and/or in the body in a direction which is proximal relative to the track section or rail when the trolley is engaged therewith, at least one said axial slot arranged to open therein and/or in the body in a direction which is distal relative to the track section or rail when the trolley is engaged therewith, and at least one said axial slot arranged to open therein and/or in the body in a direction which is lateral relative to the track section or rail in that body portion and/or in the body when the trolley is engaged therewith.

* * * * *